United States Patent [19]

Ferriss et al.

[11] 4,431,947

[45] Feb. 14, 1984

[54] CONTROLLED LIGHT SOURCE

[75] Inventors: Lincoln Ferriss, Lincoln Park, N.J.; Donald Shernoff, White Plains, N.Y.

[73] Assignee: The Singer Company, Little Falls, N.J.

[21] Appl. No.: 384,853

[22] Filed: Jun. 4, 1982

[51] Int. Cl.[3] ..... H05B 41/36

[52] U.S. Cl. ..... 315/151; 250/205; 315/116; 315/117; 315/158; 315/248

[58] Field of Search ..... 315/151, 158, 248, 307, 315/112, 115, 116, 117; 250/205; 324/304, 305

[56] References Cited

U.S. PATENT DOCUMENTS 2,975,330 3/1961 Bloom et al. ..... 315/115
3,989,983 11/1976 Uchino et al. ..... 315/248
4,256,404 3/1981 Walker ..... 250/205 X

FOREIGN PATENT DOCUMENTS 149501 9/1961 U.S.S.R. ..... 315/158

*Primary Examiner*—Eugene R. Laroche
*Attorney, Agent, or Firm*—Morris Liss; T. W. Kennedy

[57] ABSTRACT

A feedback control system for maintaining the intensity and spectral distribution of light at a predetermined level at a wavelength characteristic of the excited source. Control of that intensity, which exhibits a systematic but not necessarily a monotonic relation with excitation, is achieved by measuring and controlling the intensity of flux at another characteristic wavelength which is both systematic and monotonic.

2 Claims, 5 Drawing Figures

LAMP POWER VS EXCITATION VOLTAGE

SILICON PHOTODETECTOR RESPONSIVITY

CONTROLLED LIGHT SOURCE

BACKGROUND OF THE INVENTION

This invention relates to the production of a constant-intensity light flux at a desired wavelength using a feedback control system which maintains the intensity of a light-producing lamp at a predetermined value over a large ambient temperature range. Such a constant-intensity source is desirable in instruments utilizing the principles of nuclear magnetic resonance such as a magnetic resonance gyroscope. In this type of gyroscope, two such light source are employed, one for the purpose of "pumping" the magnetic resonance and a second for "readout" of the phase of the resonance. It is the stability of the magnetic resonance which bears on the bias performance of the gyro. Absorbed light variations arising from intensity variations of the pump lamp, operating at a wavelength of 254 nm, produce frequency changes of the resonance causing a gyro rate bias shift. Fluctuations of intensity of the readout lamp, though not strongly absorbed, also influence the frequency of magnetic resonance likewise producing rate bias changes.

BRIEF DESCRIPTION OF THE INVENTION

It is the purpose of this invention to provide a means for maintaining the intensity of the desired wavelength of light from each lamp at the prescribed level. Factors which tend to produce intensity variations include temperature, radio frequency excitation power and lamp ageing effects. Maintaining intensity is achieved by temperature control of the "cold end" of the light-producing lamp and by employing the monotonic optical output characteristic of a lamp output at a first wavelength while light at a second wavelength from the lamp output is available along a major optical axis.

BRIEF DESCRIPTION OF THE DRAWINGS

Other objects and advantages of this invention will become apparent upon reading the following detailed description and upon reference to the drawings, in which.

While the invention will be described in connection with preferred embodiments, the invention is not limited in scope to those embodiments. To the contrary, alternatives, equivalents and modifications included within the spirit and scope of the invention as defined by the appended claims are covered.

DETAILED DESCRIPTION OF THE INVENTION

Figure 1:
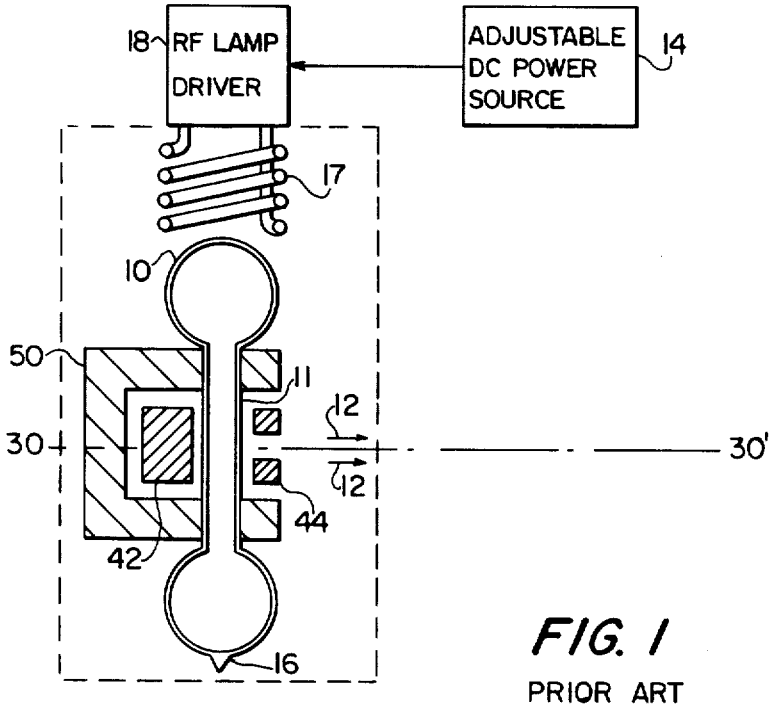
FIG. 1 PRIOR ART
FIG. 1 is a pictorial representation of key elements of a prior art RF excited light source.

FIG. 1 is intended as an example of an embodiment of prior art. A thin-walled, dumbbell-shaped lamp 10 blown from fused silica tubing is shown in cross-section. The lamp is pressurized with a few torr of argon gas and with several mg. of mercury which emits the desired optical wavelength at 254 nm when excited. The excitation is provided by a driver in the nature of a radio frequency oscillator 18 powered from a d-c supply voltage 14 by means of conductors. The voltage supply can be adjusted to provide the desired level of lamp brightness. The oscillator tank circuit coil 17 couples r-f energy into the upper spherical portion of the lamp. This manner of bulb excitation produces intense, non-self-reversed photon emission in the hollow, narrow portion 11 of the lamp 10. The useful light output represented by arrows 12 is that radiated in the direction of the major optical axis 30–30'. In the case of the read-out lamp, a permanent magnet 42 with associated keeper ring 44 provides an axial magnetic field which produces Zeeman splitting of the lamp output spectrum. The degree of this effect is adjustable by moving the magnet along the major optical axis 30–30'. Retainer assembly 50 holds the lamp in position and can serve as a structure for mounting the keeper ring 44 and the adjustment means for magnet 42. The criterion for the adjustment of the magnet is discussed in U.S. patent application Ser. No. 245,826 by I. A. Greenwood for "Magnetic Resonance Gyroscope with Spectral Control", assigned to the present assignee. Although the magnet 42 and associated keeper ring 44 are not required, their inclusion is typical in the application of a readout lamp source in a magnetic resonance gyroscope.

The optical power output of such a lamp is a strong function of lamp temperature, in particular the temperature of the coolest portion of the lamp's interior which is the bulb end 16 furthest from the excitation source. Mercury within the lamp coexists in gaseous and liquid form, the latter being at the coolest region. The number of mercury atoms in gaseous form, and therefore capable of photon emission is a function of the vapor pressure of mercury at the temperature of the liquid reservoir. Thus, the intensity of the lamp varies with the temperature of the lamp which in turn varies with the temperature of the apparatus and its location. A condition of constant intensity can only be approached after a long period of warmup and with steady ambient temperature.

Figure 2:
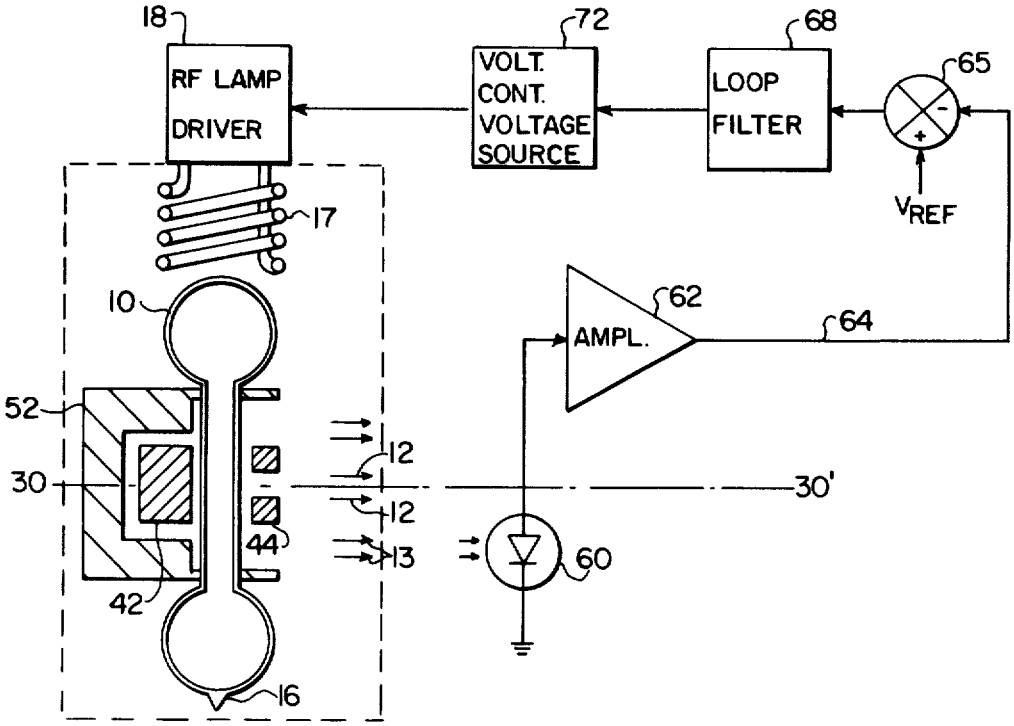
FIG. 2 is a pictorial representation of an improved embodiment of an RF excited light source wherein an optical intensity control loop has been added so as to better maintain the light intensity at the desired value.

An improved excited light source is shown in FIG. 2 wherein identical components are indicated by the same reference numerals. Lamp 10, r-f oscillator 18 and the tank coil 17 remain in the same relative position as in FIG. 1 as do the magnet 42 and keeper 44. Retainer assembly 52 is modified to permit light 13 to impinge on photodetector 60. This light is in addition to useful light 12 which remains radiated along the major optical axis 30–30'. Photodetector output current is transformed by amplifier 62 to a voltage proportional to lamp intensity on line 64 which is compared with a voltage reference at a conventional summation circuit 65 to produce an error signal input to the filter 68. The output of filter 68 is a control signal to voltage-controlled voltage source 72 which has replaced the adjustable power supply 14 of FIG. 1. Those skilled in the art recognize these elements as configured in a feedback control system wherein the attempt is made to cause the intensity of lamp 10 to be controlled to a value fixed by the magnitude of the voltage reference by varying the excitation to the lamp. Such a scheme, although an improvement, suffers from several deficiencies. Because the light output from the lamp 10 is such a strong function of bulb cold-end (16) temperature, a wide range of excitation from r-f oscillator 18 is required for operation over a wide range of apparatus and ambient temperatures. This also requires a wide voltage range output from controlled voltage source 72.

Figure 3:
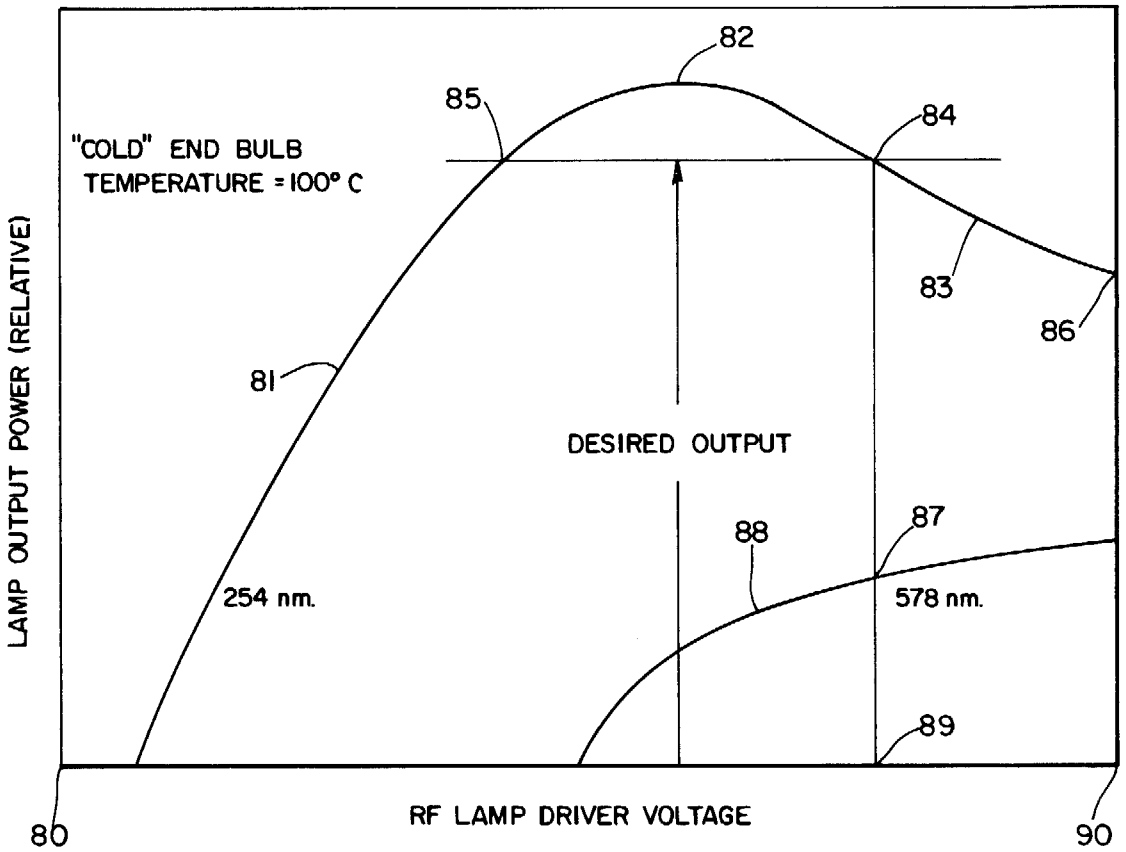
FIG. 3 is a chart which shows the relative power outputs of two wavelenghts, which are present together, of a mercury lamp as a function of the excitation source input voltage amplitude.

Another deficiency arises from the nature of the light output from the lamp as a function of the voltage to the r-f oscillator. The plot of FIG. 3 shows that, as the voltage is varied from level 80 to 90, the lamp intensity at the desired wavelength of 254 nm tends to increase along the positively-sloped portion of the curve 81 reaching a maximum value at 82 and then decreasing along negatively-sloped portion 83. The total lamp intensity tends to follow a similarly shaped curve. The presence of the non-monotonic intensity characteristic complicates the design of the feedback control system in that a condition of negative feedback with stability can be associated with the region having one polarity of slope while positive feedback and instability is associated with the opposite polarity.

Still a further complication arises from the nature of the initial turn-on of the bulb. When power is first applied to the apparatus, insufficient energetic mercury ion-pairs are available to cause the lamp to become active. Indeed, it is typical for the r-f lamp driver voltage to approach a maximum level at 90, still referring to FIG. 3, before sufficient energy is available for the lamp to provide an output. When the lamp does become active, the output level corresponds to that level 86 corresponding to driver voltage level 90. For the feedback control system to command the loop to achieve a steady-state desired intensity level 84, driver voltage must be reduced from level 90 in a direction toward level 80 causing movement along the intensity curve from 86 to 84, an increase in intensity. This control means requires that a decrease in lamp intensity results from an increase in driver voltage, a contradiction to the condition that driver voltage advance from level 80 to level 90 under loop control prior to lamp ionization.

Figure 5:
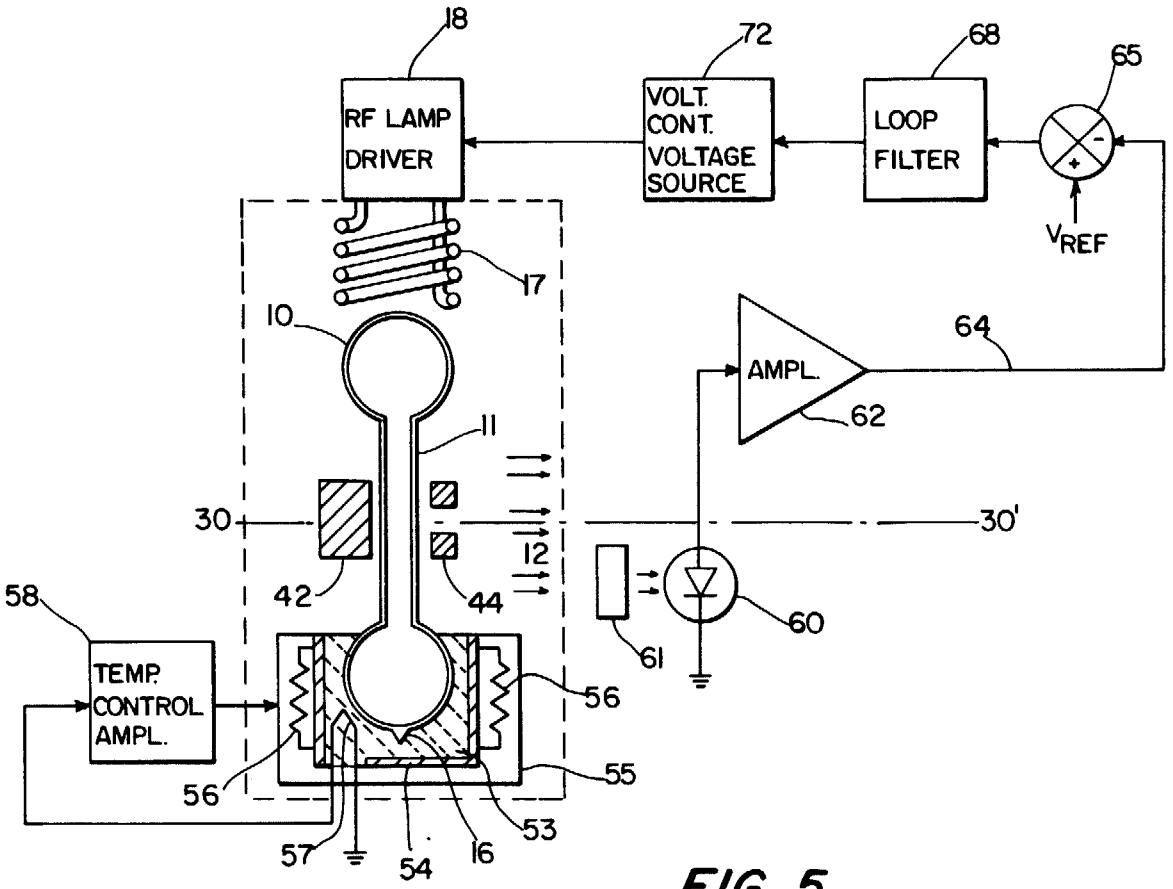
FIG. 5 is the pictorial representation of the preferred embodiment of the invention wherein the optical intensity control loop has been refined by the addition of an optical filter and a temperature control loop has been added to the modified means of supporting the light source lamp.

The objections stated for the embodiment of FIG. 2 related to wide voltage control range and lack of monotonicity can be eliminated with the preferred embodiment of the controlled light source of FIG. 5, wherein components identical to those in FIGS. 1 and 2 are indicated by the same reference numerals. Here the lamp "cold end" 16 is encapsulated in a medium 53 having the property of good thermal conducitivity such as a suitable plastic encapsulant. Cup 54 made of a thermally-conductive metal such as copper serves as a container for the "cold end" of the lamp and the encapsulant 53. Also, a temperature sensor 57 such as a thermocouple is potted in place close to the exterior of the bulb. An electrical heater 56 is attached around the outer surface of the cup and covered with a protective material 55 which also serves as the lamp mounting means, replacing retainer assembly 52 (FIG. 2). Other means (not shown) support magnet 42 and keeper 44. Connected between the output of temperature sensor 57 and heater 56 is temperature controller 58 which forms a temperature control loop for the purpose of maintaining the "cold end" 16 of the lamp at a predetermined temperature, ordinarily chosen somewhat higher than the maximum ambient or apparatus temperature. Under conditions of steady-state thermal equilibrium, which are achieved substantially more rapidly with this arrangement, heat flow is from the top bulb end where r-f energy is introduced, down the hollow thin central portion 11 of the lamp which contains the photon-emitting plasma and down to the bottom bulb, maintained at constant temperature. Heat flow continues through the protective covering and mounting means 55 to the structure of the apparatus (not shown) which also serves as a heat sink. Thus, by maintaining the "cold end" 16 of the lamp at constant temperature, that variation of lamp intensity due to cold-end temperature variation is removed along with wide power variation from r-f lamp driver 18 and corresponding large voltage variations from voltage-controlled voltage source 72.

The additional novelty of this invention is in the manner by which optical intensity control at the desired, useful wavelength of 254 nm is achieved by using the monotonic optical output characteristic at a coexisting wavelength of 578 nm, shown by curve 88 in FIG. 3. Actually, the 578 nm line is composed of a pair of prominent lines at 577 and 579 nm which maintain a fixed spectral power ratio. It is common to refer to this pair of lines as a single line at 578 nm, especially in context with an optical bandpass filter, about to be described.

Referring to FIG. 5 the optical feedback control system is identical to that previously described in connection with FIG. 2 except now optical bandpass filter 61 is placed in front of photodetector 60, permitting light only at 578 nm to illuminate the diode. Because that lamp output characteristic is monotonic, difficulties related to lockup, oscillation, ambiguity and lamp startup sequence are removed. Since relative outputs at these wavelengths remain stable, increasing the gain of amplifier 62 by a suitable factor to account for that relative output ratio and for relative photodetector responsivity control at the 254 nm wavelength is achieved.

A further consideration which is a feature of the preferred embodiment which leads to further improved control is the selection of the control wavelength, chosen here to be 578 nm, with respect to the responsivity of the photodetector device. Many photodetector devices, such as photomultiplier tubes and photodiodes are available for use, but in this application a silicon photodiode offers advantages of small size and weight and generally is well suited.

Figure 4:
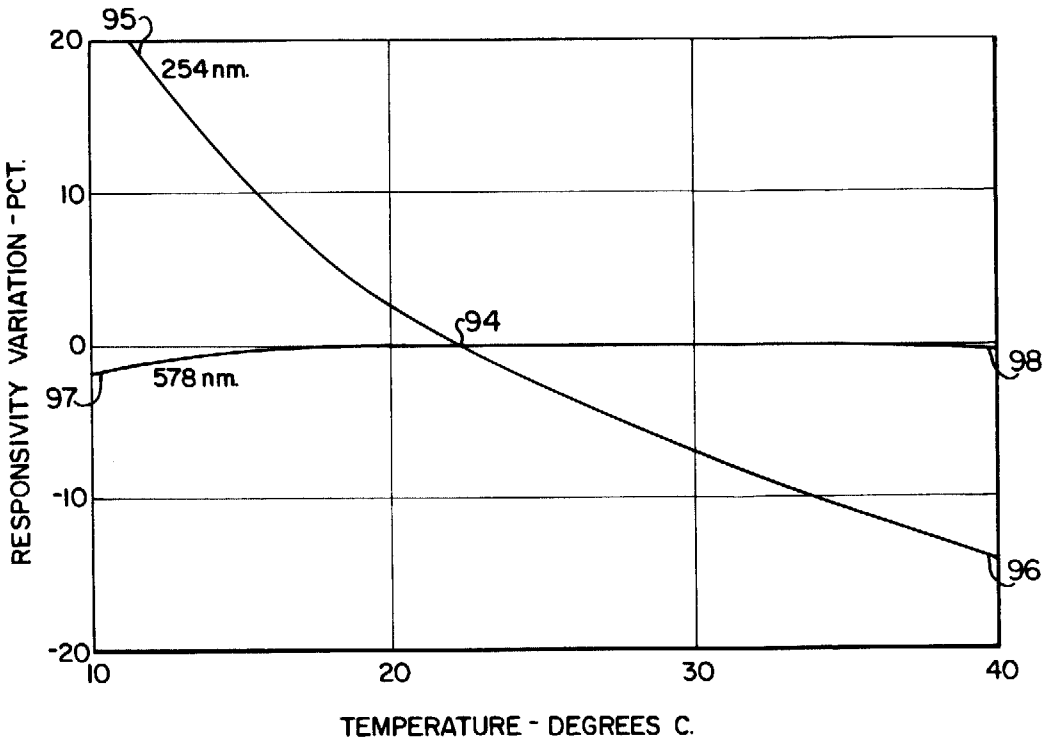
FIG. 4 is a chart which shows the responsivity of a silicon photodetector at two wavelengths of light as a function of the temperature of the photodiode.

In FIG. 4 the responsivity of a typical silicon photodiode to light at 254 nm and 578 nm is shown relative to a normalized output point 94 at 22° C. Were the light impinging on the photodiode left unfiltered, or selected to be 254 nm, the responsivity curve exercised over temperature would be essentially that represented by line 95–96, due to the large content of 254 nm light in the output if unfiltered. Since the photodiode is not temperature controlled, but exposed to the apparatus and ambient temperature which may change over a wide range, the forward gain of this feedback control system prior to the summation circuit 65, which includes responsivity of the photodiode, would change well over 30 percent for a change of temperature of the photodiode from 10° to 40° C. Those skilled in the art of servo design and analysis will recognize this as a direct intensity error of that same percentage. Whereas by using a 578 nm filter (61 of FIG. 5) responsivity curve 97–98 of FIG. 4 is exercised representing perhaps only a 2 percent error over that same temperature range.

Thus, it has been shown that with the preferred embodiment represented by FIG. 5 a light source exhibiting constant intensity and spectral distribution can be made. It will be apparent to those skilled in the art that controlled light source apparatus of the present invention is not limited to use with magnetic resonance gyros, or even to mercury vapor light sources. For example, lamps with anode and cathode electrodes connected to a d-c current supply could have been used in place of the electrodeless lamp 10 and r-f oscillator 18 combination. In addition, different photodetectors utilizing other photosensitive materials could have been used in place of photodetector 60. Also, other wavelengths which exhibit monotonicity could be used alone or together for the control function.

In any case, controlled source apparatus which fully satisfies the aims and advantages set forth above has been provided. While the controlled light source apparatus has been described in connection with certain specific embodiments, the invention is not limited to those embodiments. All embodiments within the spirit and broad scope of the claims to be appended are covered.

We claim:

1. A controlled light source comprising:

a dumbbell-shaped lamp having an elongated envelope with an enlarged upper end and an enlarged lower end and a narrow middle portion disposed therebetween;

temperature controlling means disposed adjacent to said lower end for controlling the temperature at said lower end to aid in maintaining level intensity of the lamp during its operation;

radio frequency means disposed adjacent to said upper end for exciting the lamp;

filtering means for filtering a portion of the light directed along the lamp's major optical axis to derive a monotonic wavelength component, said filtering means being disposed adjacent to said middle portion;

detecting means for detecting the intensity of the monotonic component, said detecting means being disposed adjacent to said filtering means; and feedback means connected between the detecting means and the radio frequency means for controllably exciting the lamp in accordance with the intensity of the monotonic component;

wherein the temperature controlling means comprises:

means encapsulating the lower end;

heat conductive means for containing the encapsulating means;

at least one heating element positioned adjacent to the conductive means;

means located adjacent to the lower end for sensing the temperature of the lower end; and means connected in circuit with the sensing means and heating elements for controlling electrical power delivered to the elements.

2. The structure set forth in claim 1, wherein the detecting means comprises:

a photodetector, and amplifier means connected to the output of the photodetector for producing a signal corresponding to the monotonic component intensity; and wherein the feedback means comprises a summation circuit having a reference signal provided at a first input and the signal from the amplifier means at a second input thus generating an error signal at the output of the circuit, and a voltage-controlled voltage source connected at its input in series with the output of the summing circuit; and wherein the radio frequency means is connected to the output of the source for exciting the lamp, and comprises a driver connected at its output to a radio frequency tank coil.

* * * * *